US005687419A

United States Patent [19]

Earle et al.

[11] Patent Number: 5,687,419

[45] Date of Patent: Nov. 11, 1997

[54] METHOD OF PROCESSING PHOTOGRAPHIC MATERIAL AND PHOTOGRAPHIC PROCESSING APPARATUS

[75] Inventors: Anthony Earle, Harrow Weald; John Richard Fyson, Hackney, both of England

[73] Assignee: Eastman Kodak Company, Rochester, N.Y.

[21] Appl. No.: 662,550

[22] Filed: Jun. 13, 1996

[30] Foreign Application Priority Data

Jun. 16, 1995 [GB] United Kingdom ..... 9512266

[51] Int. Cl.[6] ..... G03D 5/06

[52] U.S. Cl. ..... 396/608; 396/604; 396/614; 396/624

[58] Field of Search ..... 396/598, 604, 396/607, 608, 606, 614, 634, 635, 623, 624, 625, 620

[56] References Cited

U.S. PATENT DOCUMENTS

| | | | |
|---|---|---|---|
| 2,605,684 | 8/1952 | Nagels et al. . | |
| 3,943,541 | 3/1976 | Hirafuji . | |
| 4,444,480 | 4/1984 | Freeman | 396/598 |
| 4,613,223 | 9/1986 | Cherry et al. . | |

FOREIGN PATENT DOCUMENTS

| | | |
|---|---|---|
| 1522104 | 8/1978 | United Kingdom . |
| 1582219 | 1/1981 | United Kingdom . |
| 93/11463 | 6/1993 | WIPO . |
| 93/11464 | 6/1993 | WIPO . |

*Primary Examiner*—A. A. Mathews
*Attorney, Agent, or Firm*—Frank Pincelli

[57] ABSTRACT

Described herein is a method and apparatus for processing photographic material in sheet form. The sheet (2) to be processed is formed into a generally tubular configuration and inserted between the nip of a pair of drive rollers (4, 6). Processing solution is applied to one or both surfaces of the sheet (2) via hopper arrangements (20, 22) formed in association with drive rollers (4, 6) and/or by applicator rollers (40, 42) having associated hoppers (44, 46) which are spaced from the drive rollers (4, 6). Squeegee rollers (30, 32) are also provided for removing excess processing solution.

11 Claims, 2 Drawing Sheets

METHOD OF PROCESSING PHOTOGRAPHIC MATERIAL AND PHOTOGRAPHIC PROCESSING APPARATUS

FIELD OF THE INVENTION

This invention relates to a method of processing photographic material and to a photographic processing apparatus.

BACKGROUND OF THE INVENTION

Processing photographic materials in drum processors is well known in the art and are generally used to process photographic material in the form of sheets of photographic paper. Photographic paper has an emulsion or light-sensitive surface and a non-sensitive or reverse surface. The light-sensitive surface is exposed to a light pattern, for example, by shining light through a photographic negative onto the light-sensitive surface. The emulsion or light-sensitive surface changes in response to the light pattern and a latent image is formed in the light-sensitive surface which may be developed into a photograph or visible image by a series of processing steps. These processing steps typically involve sequential treatment of the light-sensitive surface of the paper with developer, bleach (if the photographic paper is colour sensitive), fixer (or a combination of bleach-fix (blix)), and a wash or stabilizer. Generally the developer, bleach and fixer are solutions, usually water-based solutions of various chemicals as is well known in the art. Once the paper has been processed, it is dried.

In one type of drum processor, photographic material is processed inside the drum. A sheet of photographic material is arcuately located about the inner wall of the drum. One surface of the sheet, the non-sensitive surface, is in contact with the inner surface of the drum. The other surface, the sensitive surface, faces the interior of the drum and is processed by introducing processing solutions into the drum in sequence, while rotating or agitating the drum with its axis horizontal.

In another type of drum processor, a sheet of photographic material is held on the outside of the drum with the non-sensitive surface of the sheet in contact with the outside surface of the drum. Processing solutions are applied to the drum by rotating it in a reservoir containing the processing solutions to develop the latent image carried by the light-sensitive surface of the material.

Alternatively, the sensitive surface of the sheet may be processed in contact with a patterned drum surface. In this case, the surface of the sheet is transported over the surface of the drum at a relative speed which both provides agitation and prevents adherence of the sensitive surface to the surface of the drum.

U.S. Pat. No. 4,613,223 discloses an arrangement in which a flexible sheet of photographic material is driven along an endless curved path within a processing tank by passing the sheet through nips formed between at least one pair of driven rollers. At least one of the driven rollers is the drum itself. During processing, the emulsion (sensitive) surface of the sheet is arranged not to come into contact with any stationary part of the processing vessel as it is being processed. This prevents damage to the surface during processing. After driving the sheet around the endless path for a predetermined number of cycles, which defines the processing time, the sheet is then directed out of the processing tank.

U.S. Pat. No. 2,605,684 discloses an arrangement in which helically wound grooves formed on rollers are used to transfer processing solution from a reservoir and to apply the solution to photographic material being processed. A small portion of the surface of each grooved roller is used to effect such transfer and application.

U.S. Pat. No. 3,943,541 discloses an arrangement in which a helically grooved roller is used to apply processing solution to photographic material being processed. In this arrangement, processing solution is applied to the surface of the roller from a tank, the material being processed passing over the tank and then roller in turn during processing.

Published European Patent Application EP-A-0 614 545 discloses a rotating drum arrangement in which low volumes of processing solutions are used allowing unstable and single use chemistry to be efficiently used.

Published European Patent Application EP-A-0 614 544 describes a rotating drum arrangement to form a low volume processing tank, the surface of the drum having a spiral formed either on or in its surface.

Problem to be Solved by the Invention

Most drum processors suffer from the disadvantage that only one surface of the sheet of photographic material may be processed at one time. Although the photographic paper referred to above has only one sensitive surface, some sheet photographic materials, such as medical X-ray photographs are light-sensitive on both surfaces and both surfaces of the sheet require processing/development. Another type of photographic material, for example, a graphic arts scanner film, has only one light-sensitive surface, but has a coating on its reverse surface. That coating is a light absorbent layer of gel, known as a pelloid layer, which has to be removed during processing. Conveniently, developer will remove the pelloid layer.

GB-A-1 582 219 and GB-A-1 522 104 describe drum processors in which both surfaces of a sheet of photographic material can be processed at one time. However, the drum processors described in those documents are complicated. They both rely on mounting sheets of photographic material on inserts which are inserted into a drum. Not only does this increase the expense of the processor, it also increases the likelihood of contamination of one processing station with chemistry from another unless both sides of the material are washed.

Contamination of the drum with processing solutions is a major problem associated with drum processors. If the photographic material is attached to the drum, solutions used in the processing can seep into any spaces between the surface of the photographic material and the drum. Whilst it is undesirable for the fixer to be contaminated by the developer, a small amount of contamination can be tolerated. However, if the developer becomes contaminated with fixer, this is a more serious problem, since the fixer badly affects the chemical reaction of the developer. Thus each time a drum processor is used to process a sheet of photographic material it has to be thoroughly cleaned. With some of the more complicated designs of drum processor such as those described in GB-A-1 582 219 and GB-A-1 522 104, there are many recesses and the like in those processors in which developing solutions can collect. Consequently, they are difficult to clean effectively.

A further problem with most drum processors is that it is necessary to remove the photographic material from the drum to allow a sufficient quantity of washing solution to contact the material to effect washing of the photographic material. Furthermore, the back surface of the material must also be washed to remove any processing solution which has penetrated on to that surface due to capillary action of the solution.

SUMMARY OF THE INVENTION

It is therefore an object of the present invention to provide a method and apparatus for allowing both sides of a sheet of photographic material to be processed without the problems discussed above.

In accordance with a first aspect of the present invention, there is provided a method of processing a sheet of photographic material, the method comprising the steps of:

a) forming the sheet into a generally tubular configuration;
b) rotating the sheet using at least one pair of drive rollers between which the sheet has been inserted; and
c) applying processing solution to at least one surface of the sheet.

The sheet may be joined to hold it in the generally tubular configuration and may be joined prior to insertion between the drive rollers.

Processing solution may be applied to at least one surface of the sheet using at least one of the drive rollers. If both surfaces of the sheet are to be processed, solution is applied to both drive rollers.

Alternatively, processing solution can be applied directly onto either one or both surfaces of the sheet.

In accordance with another aspect of the present invention, there is provided photographic processing apparatus for processing a sheet of photographic material formed into a generally tubular configuration, the apparatus comprising:

at least one pair of drive rollers for rotating the sheet; and application means for applying processing solution to at least one surface of the sheet.

The application means may comprise at least one of the drive rollers, and may include at least one blade located adjacent a drive roller to co-operate therewith to define a hopper for supplying processing solution to said drive roller.

Alternatively, the application means may include at least one roller of a roller pair spaced from the drive rollers.

A pair of squeegee rollers disposed on either side of the sheet for removing excess processing solution from at least one surface of the sheet may also be provided.

Advantageous Effect of the Invention

By forming the sheet of material into a tube and continuously feeding the same between a pair of drive rollers, the present invention does not require a drum. By dispensing with the drum, the problems of contamination of the drum are automatically avoided. The only source of contamination is the rollers themselves and, if used, the hoppers for supplying processing solution on to the rollers which are simple to wash.

Further, both surfaces of a sheet of photographic material may be processed simultaneously. This is particularly advantageous in developing medical X-ray photographs and graphic arts scanner material. Also, both surfaces of the material may be washed without having to take the material off a drum.

BRIEF DESCRIPTION OF THE DRAWINGS

For a better understanding of the present invention, reference will now be made, by way of example only, to the accompanying drawings in which.

DETAILED DESCRIPTION OF THE INVENTION

Figure 1:
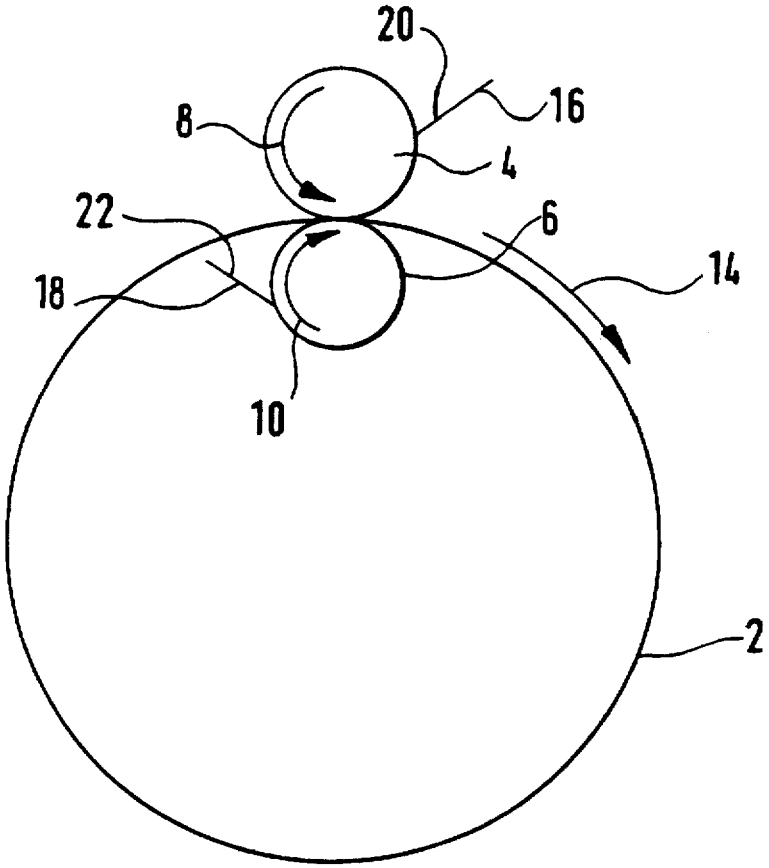
FIG. 1 is a schematic illustration of a first embodiment of a photographic processing apparatus constructed in accordance with the present invention.

Referring initially to FIG. 1, a rectangular sheet of photographic material is shown which has been rolled into a flexible tube 2 by joining two opposed edges of the material. The edges are secured together by means of a clip (not shown) so that there is no overlap of the exposed light-sensitive areas of the material which carry a latent image to be developed. The tube 2 is shown inserted between two drive/applicator rollers 4, 6. The rollers 4, 6 are arranged to rotate in anti-clockwise and clockwise directions respectively, as shown by the arrows 8, 10. Rotation of the drive rollers causes the tube 2 to rotate about its central axis in the direction shown by the arrow 14.

A blade 16, 18 abuts the surface of each roller 4, 6. Each blade 16, 18 co-operates with its adjacent roller 4, 6 to define a hopper 20, 22.

In use, a sheet of photographic material which is to be processed is secured in a generally tubular configuration 2 and is inserted between rollers 4, 6 as described above, and as illustrated in FIG. 1.

The drive rollers 4, 6 rotate to cause the tube 2 to rotate. If both surfaces of the sheet of photographic material are to be developed processing solutions are dribbled into both hoppers 20, 22 and are transferred to both inner and outer surfaces of the tube by the rollers 4, 6. If only one side of the sheet is to be processed, processing solution is dribbled into one hopper appropriate for that side of the sheet. The tube 2 of material is rotated a number of times until the particular processing step being carried out is completed.

Several processing solutions are applied to the photographic material in sequence so that a complete processing operation is carried out while holding the sheet in one pair of rollers 4, 6. If the photographic material were photographic paper as described above, the solutions would be developer, bleach, fixer, and then water, for washing, and the corresponding processing stages would be carried out while the tube 2 is held between the rollers 4, 6. A tray (not shown) may be provided to catch any excess processing solution.

Figure 2:
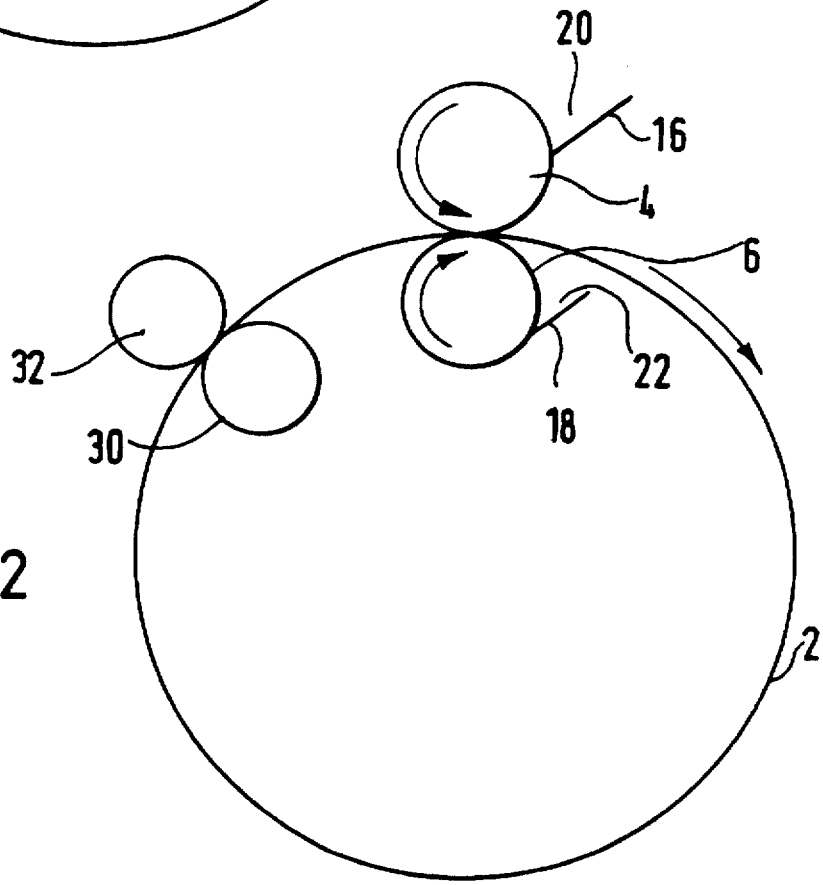
FIG. 2 is a schematic illustration of a second embodiment of a photographic processing apparatus constructed in accordance with the present invention.

FIG. 2 shows a processing apparatus which is similar to that shown in FIG. 1 and in which identical parts bear the same reference numerals. The apparatus of FIG. 2 includes a pair of squeegee rollers 30, 32. One squeegee roller 30 is disposed inside the tube 2, the other squeegee roller 32 is disposed outside the tube The squeegee rollers 30, 32 may be brought into contact with the outside and inside surfaces of the tube to remove any excess solution from the surfaces of the sheet. The solutions removed by the squeegee rollers may be collected for use in processing further sheets of material.

Figure 3:
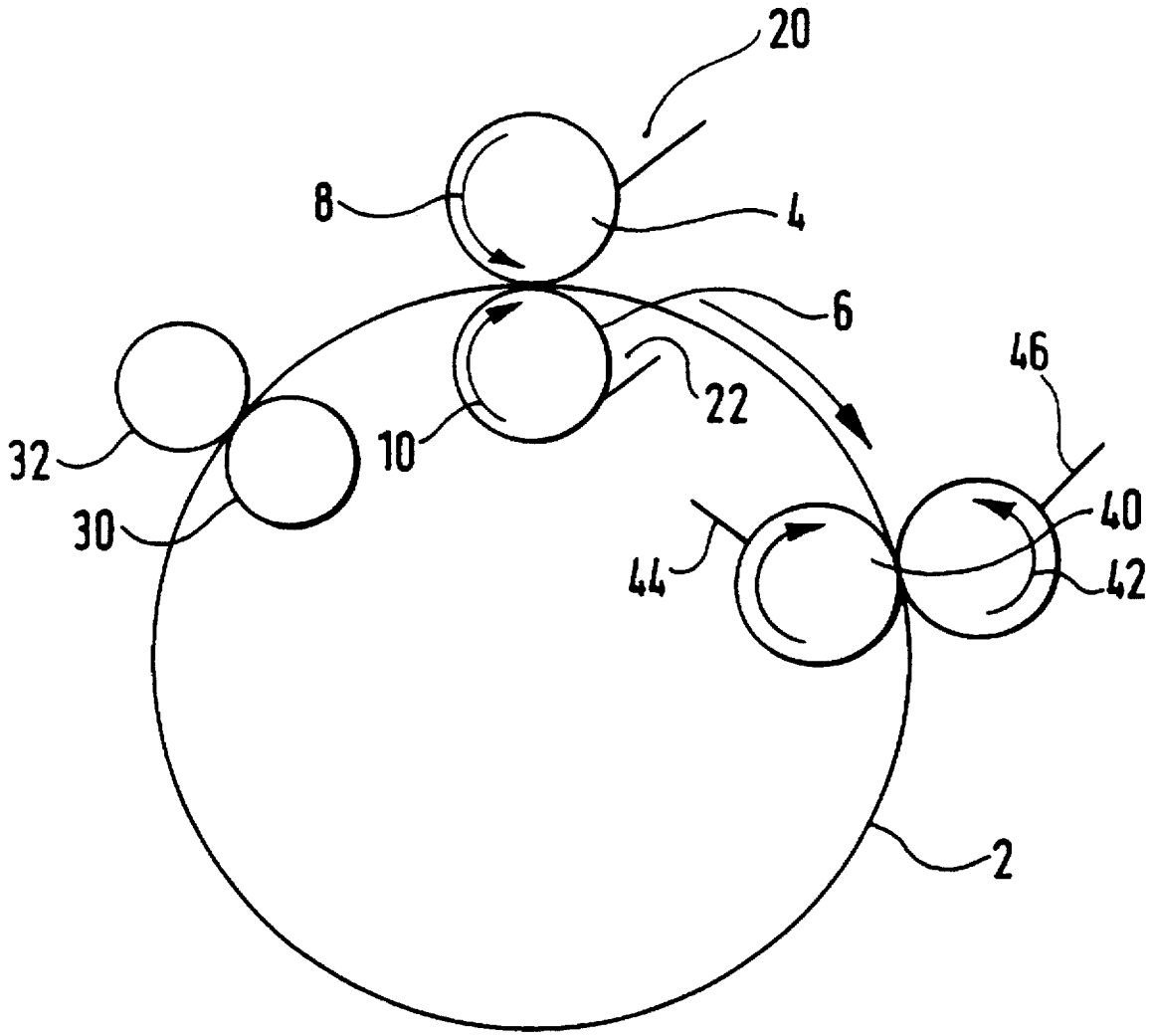
FIG. 3 is a schematic illustration of a third embodiment of a photographic processing apparatus constructed in accordance with the present invention.

FIG. 3 shows a further embodiment which is similar to those shown in FIGS. 1 and 2 and in which identical parts carry the same reference numerals. In the apparatus shown in FIG. 3, an additional pair of drive rollers 40, 42 and blades defining hoppers 44, 46, are provided. Again, one roller 40 is disposed on the inside of the tube 2 and another, 42, is disposed on the outside. This embodiment allows the simultaneous or staggered application of two different solutions to the surfaces of the sheet. This embodiment is particularly useful in applying redox amplification developers, which include both an oxidising and a reducing agent and are thus unstable. The reducing agent, which is applied to the surface of the sheet first, may be carried in one hopper, say hopper 20, of the first pair of drive rollers. The reducing agent may be carried in hopper 46 of the additional pair of rollers.

The embodiments of the invention described above described above may be used in a darkroom. Alternatively, the apparatus may be housed in a light tight container.

In place of the single pair of drive rollers which also act as applicator rollers described above in relation to FIG. 1, it would be possible to have a drive rollers located co-axially with rollers 4, 6 on each side of each roller 4, 6 to rotate the tube while the rollers 4, 6 act mainly as applicator rollers to apply processing solutions to the surfaces of the tube.

The surfaces of the drive rollers described above may be made of materials other than rubber such as PVC or any other suitable material.

The surface of each roller 4, 6 may be engraved with a suitable pattern. One such suitable pattern is an engraved groove (not shown) extending helically around the surface of the roller. The engraved groove enables a measured amount of processing solution to be delivered to the surface of the sheet of photographic material. The groove also provides agitation of the processing solution which improves processing.

Other patterns may be formed in the surface of the rollers for example a series of grooves or splines may be formed in the surface of the rollers. Alternatively, the rollers may have plain surfaces.

The embodiments of the invention described above may be used for developing a wide range of photographic materials and are not limited to developing sheets of photographic paper. For example the apparatus and method may be used in a process to develop colour transparency films, known as a reversal process. Further although the invention is described in terms of developing a single sheet of photographic material, that sheet may be an elongate strip of photographic paper carrying a series of photographic images which may be cut into individual photographs once the processing is completed. Also, it would be possible to join a number of individual sheets into a tube by joining the edges of those sheets together in series.

The terms "tube" and "tubular" are not restricted to cylindrical configurations. The shape the tube 2 adopts will vary depending on the length of the sheet between the joined edges and the flexibility of the material of the sheet.

Although in the specific embodiments described above include a hopper for applying processing solutions to the rollers, in an alternative embodiment (not shown) the processing solutions may simply be sprayed directly onto the rollers or the sheet itself.

The sheet of photographic material is described above as being secured in a tubular configuration by a clip, however, other means, for example, sticky tape could be used. If the sheet has a polymer base or is coated with a polymer such as polythene, the edges may be secured together by heating that base or coating above the polymer melting point and applying pressure to weld the edges together.

Naturally, the sheet may be joined to form the tube 2 after it has been inserted into the drive rollers.

Processing solution need not be applied to the sheet via the drive rollers and/or hopper arrangements described above. The solutions can be applied directly to the material itself using spray bars.

We claim:

1. A method of processing a sheet of photographic material, the method comprising the steps of:

a) forming the sheet into a generally tubular configuration, said sheet being joined to hold it in the generally tubular configuration;

b) rotating the sheet using at least one pair of drive rollers between which the sheet has been inserted; and c) applying processing solution to at least one surface of the sheet.

2. A method according to claim 1, wherein the sheet is joined prior to insertion between the drive rollers.

3. A method according to claim 1, wherein step c) is achieved by applying the solution onto at least one of the drive rollers.

4. A method according to claim 3, wherein solution is applied to both drive rollers so that processing solution is applied to both surfaces of the sheet.

5. A method according to claim 1, wherein step c) is achieved by applying the solution directly onto the sheet.

6. A method according to claim 5, wherein solution is applied to both surfaces of the sheet.

7. Photographic processing apparatus for processing a sheet of photographic material formed into a generally tubular configuration, the apparatus comprising:

at least one pair of drive rollers for rotating the sheet; and at least one of the drive rollers applying processing solution to at least one surface of the sheet.

8. Apparatus according to claim 7, wherein the application means includes at least one blade located adjacent a drive roller to co-operate therewith to define a hopper for supplying processing solution to said drive roller.

9. Apparatus according to claim 7, wherein the application means includes at least one roller of a roller pair spaced from the drive rollers.

10. Apparatus according to claim 7, including a pair of squeegee rollers disposed on either side of the sheet for removing excess processing solution from at least one surface of the sheet.

11. An assembly comprising an apparatus according to claim 7, and a generally tubular sheet of photographic material inserted between each pair of rollers in that apparatus.

* * * * *